United States Patent [19]

DeFino et al.

[11] Patent Number: 4,484,392

[45] Date of Patent: Nov. 27, 1984

[54] METHOD AND MEANS OF INSTALLING SIDING

[76] Inventors: Armond A. DeFino, 3803 SW. 13th St.; Frank J. DeFino, 300 SE. Granger, both of Des Moines, Iowa 50315

[21] Appl. No.: 297,342

[22] Filed: Aug. 28, 1981

[51] Int. Cl.[3] ..... G01B 3/30

[52] U.S. Cl. ..... 33/187

[58] Field of Search ..... 33/188, 187

[56] References Cited

U.S. PATENT DOCUMENTS

| | | | |
|---|---|---|---|
| 97,436 | 11/1869 | Pedrick | 33/187 |
| 334,363 | 1/1886 | Ervin | 33/187 |
| 368,574 | 8/1887 | Eby | 33/187 |
| 520,472 | 5/1894 | Absher et al. | 33/187 |
| 4,164,346 | 8/1979 | Sickler | 33/188 |

*Primary Examiner*—Harry N. Haroian

*Attorney, Agent, or Firm*—Zarley, McKee, Thomte, Voorhees & Sease

[57] ABSTRACT

A gage for installing siding is disclosed comprising a frame means having a support portion for supporting a first length of siding against a supporting wall. A hook portion is secured to the frame means and is adapted to hook on the upper edge of an installed length of siding. A release means is secured to the frame to release the first length of siding to permit the frame and the hook to be first raised to release the hook portion from the installed length of siding and then to permit the hook portion to be moved downwardly with the frame means so that the gage is disengaged from the siding.

A method for installing siding is disclosed comprising the steps of mounting a first length of siding to a supporting wall, hooking identical gage members on the upper edges of the first siding member, placing a second siding member on said gages in overlapping condition with the first siding member, securing the second siding member to the wall at the upper edges thereof, unhooking said gage members from the first siding member by moving the gage members upwardly, and then moving the gage members downwardly from between the first and second siding members.

3 Claims, 8 Drawing Figures

METHOD AND MEANS OF INSTALLING SIDING

BACKGROUND OF THE INVENTION

Overlapping siding members have been used on homes and buildings for over a century. It is difficult for one person to install such siding because each siding member must be precisely horizontal and must be precisely uniformly placed with respect to the other siding members.

Various gages have been devised to permit one person to install siding, these gages are secured to an installed length of siding and support a second siding member to be installed. The gages serve to hold the siding member to be installed in a predetermined position.

However, the siding gages of the prior art are quite complex in construction. They are not readily releasable from the siding members after installation has taken place. Further, some of the prior art devices invite some damage or scarring to the members upon which they are used.

BRIEF SUMMARY OF THE INVENTION

Two siding gages are disclosed herein. Each comprise a frame means with two upstanding arms adapted to hold and stabilize a siding member to be installed. One of the upstanding arms has a hook portion which is adapted to support the gage on a previously installed siding member.

The upstanding arm with the hook portion thereon in one form of the invention is releasably pivotally mounted to the frame to permit its selective disengagement from the siding member upon which it is hooked. A second embodiment of the invention achieves this release through the operation of a spring loaded bolt element which permits the installed siding member to be free for relative movement therewith by the gage.

The method disclosed contemplates the installation of a first siding member in a horizontal position. A plurality of gages are then hooked to the top edge of the installed siding member. A siding member to be installed is then mounted on the gages and is tacked to the supporting wall at the upper edges thereof. The gages are then unhooked from the installed siding member and the process is then repeated until the entire wall surface is covered by a plurality of siding members.

Therefore, a principal object of this invention is to provide a method and means of installing siding which will efficiently allow a single person to install siding members on a wall surface.

A further object of the invention is to provide a gage means for mounting siding members which is easily installed.

A further object of the invention is to provide a gage means for siding members which can be easily disengaged from the siding members after installation has taken place.

A further object of this invention is to provide a gage for installing siding members which can be selectively adjusted to accommodate different conditions of overlapping of the siding members.

A further object of this invention is to provide a method of installing siding members which is fast and efficient.

These and other objects will be apparent to those skilled in the art.

DESCRIPTION OF THE PREFERRED EMBODIMENT

Figures 1, 2, 3, 4, 5, 6, 7, 8:
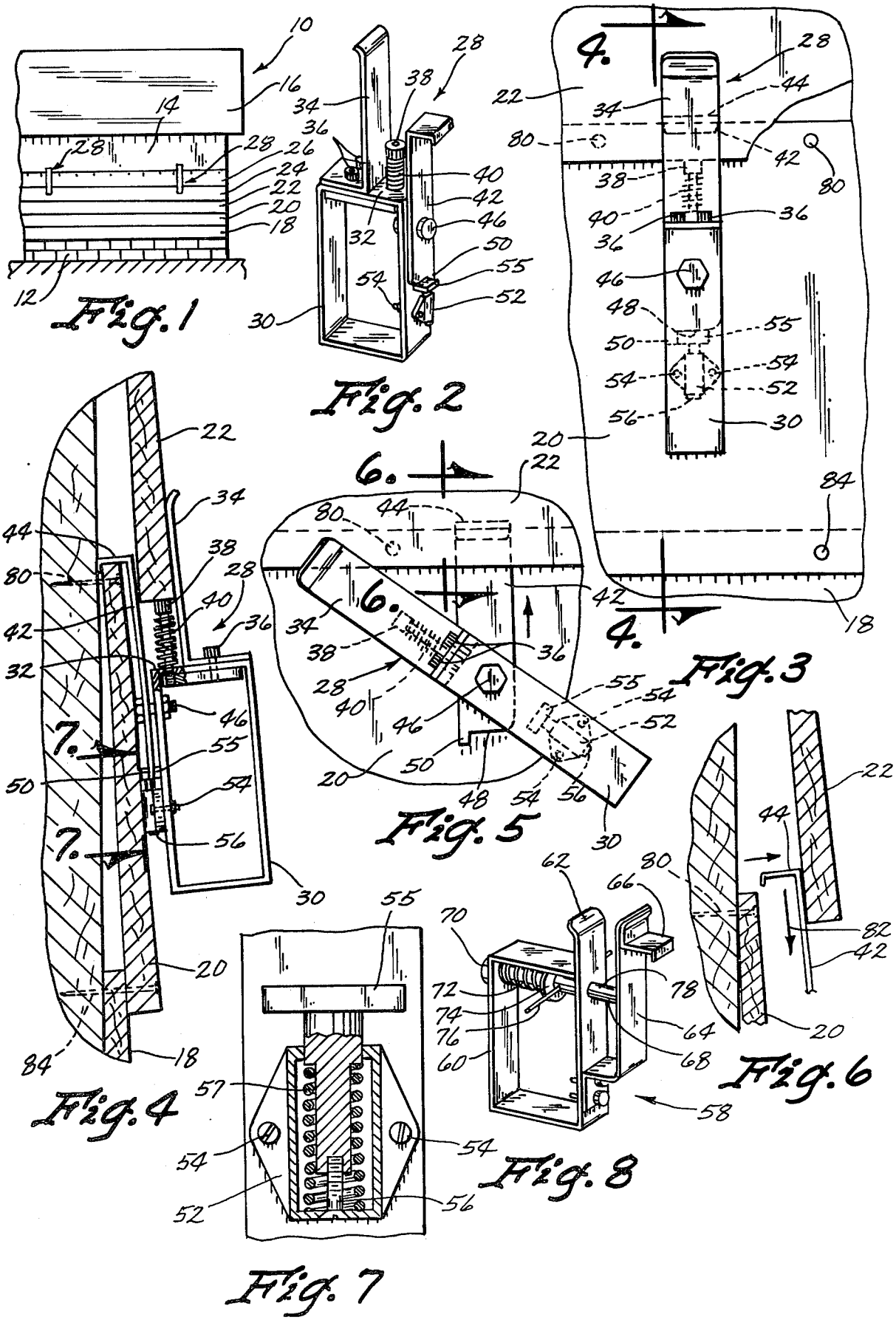
FIG. 1 is a partial elevational view of a building upon which the method and device of this invention are being used.
FIG. 2 is a perspective view of the device of this invention.
FIG. 3 is an elevational view of the device of this invention as used in FIG. 1.
FIG. 4 is a sectional view taken on line 4—4 of FIG. 3.
FIG. 5 is an elevational view similar to that of FIG. 3 but showing the gage device in a subsequent position just prior to removal from the building structure.
FIG. 6 is a sectional view taken on line 6—6 of FIG. 5.
FIG. 7 is an enlarged sectional view of the plunger bracket and plunger.
FIG. 8 is a perspective view of an alternate form of the invention.

The numeral 10 designates a dwelling having a foundation 12, a supporting wall 14 and a roof 16. Siding members 18, 20, 22, and 24 are shown installed on the supporting wall 14 as will be described hereafter.

With reference to FIG. 2, gage 28 is comprised of frame 30 which has a top portion 32. A retainer flange or arm 34 extends upwardly from frame 30 and is secured to the top portion 32 by means of bolts 36. A vertically disposed adjustment screw 38 is threadably mounted in top portion 32 and is frictionally held against rotation by spring 40.

Arm 42 extends upwardly from the inner side of frame 30. The upper end thereof terminates in hook element 44. Arm 42 is pivotally secured to the inner side of frame 30 by means of pin 46. The lower end of arm 42 terminates in cam surface 48 which has a limiting finger 50 at one side thereof, as best seen in FIG. 5.

A plunger bracket 52 is secured to the side of frame 30 just below the lower end of arm 42. Plunger bracket is secured to the frame by screws 54. A spring loaded plunger 55 is slidably mounted on pin 56 which extends upwardly from the bottom end of the plunger bracket 52. A compression spring 57 holds the plunger in the position of FIG. 7 and yieldingly resists the downward movement of the plunger in the plunger bracket and on pin 56.

An alternate form of the invention is shown in FIG. 8. Gage 58 is comprised of frame 60 which has an upwardly extending retainer flange or arm 62 similar to arm 34 of gage 28. An arm 64 is secured in any convenient fashion to the inner side of frame 60. The upper end of arm 64 terminates in hook element 66.

A plunger bolt 68 slidably extends through frame 60. Head 70 of plunger bolt 68 is positioned adjacent the outer side of gage 58. A compression spring 72 embraces plunger bolt 68 and engages washer 74 which is retained by retainer pin 76 which extends through the plunger bolt. The spring 72 normally holds the plunger bolt in the position shown in FIG. 8 wherein the inner end 78 of the bolt extends in the space between arms 62 and 64.

The initial siding member 18 is leveled with a conventional carpenter's level and is secured to the supporting wall 14 by a plurality of nails which extend through the lower portion of the siding member. The hook element 44 of gage 28 is then imposed between the wall 14 and the upper edge of the siding member 18. The typical position of the hook 44 with respect to the upper edge of an installed siding member is typically shown in FIG. 4. A second gage 28 is similarly placed on the installed siding member adjacent the opposite end thereof as generally shown in FIG. 1.

The screw 38 is selectively adjusted at an equal height above the frame 30 to provide the desired overlap between successive siding members. The spring 40 retains the screw 38 in its predetermined adjusted position.

A subsequent siding member to be installed, such as siding member 22, is placed within the space between arms 34 and 42 of gage 28 as generally shown in FIG. 4. Such a siding member will be precisely level and parallel with the installed siding member therebelow.

The siding member to be installed is then lightly nailed with approximately three nails at the top portion thereof to the supporting wall. Nails used for this purpose are shown by the numeral 80 in FIG. 4. It should be understood that the nails 80 in FIG. 4 are shown as they remain after the siding member through which they extend have been completely installed.

After the siding member to be installed has been tacked in place by nails 80, the gages 28 should be removed from their respective operative positions. This is accomplished by rotating the frame 30 in a counterclockwise position as shown in FIG. 5. Rotation of the frame in this direction is permitted as cam surface 48 departs from the upper portion of the spring loaded plunger 55. The frame should be rotated to a substantially horizontal position so as to clear the bottom portion of the siding member being installed.

With reference to FIG. 6, the gage 28 is then pushed slightly upwardly so that the hook member 44 disengages the top of the siding member being installed. The gage member is then pulled outwardly to a slight extent so that the hook portion can move in a downward direction between the installed siding member and the siding member being installed. A quick downward movement of the gage will permit the gage to be removed as shown by the arrow 82 in FIG. 6. It should be noted that the siding member 20 in FIG. 6 can be pulled outwardly slightly from the wall 14 because it is only lightly tacked to the wall at its top edge by the nails 80.

As illustrated in FIG. 4, siding member can then move back against the previously installed siding member 18. Nails 84 can then be driven through the lower edge of siding member 20 to effect a permanent connection to the supporting wall. After hook element 66 is placed on the upper edge of the installed siding member, the siding member to be installed is placed in supporting position on the portion 78 of plunger bolt 68. After the siding member being installed is tacked at the top edge thereof by nails 80 as described above, manual pressure is applied in an outwardly direction in pin 76 to pull plunger 68 out from under the siding member being installed. This permits the gage 58 to be slightly raised to disengage hook element 66 from the upper portion of the installed siding member. The gage 58 is then removed from its operative position by a slight outward movement and thence a downward movement as was the gage 28.

From the foregoing, it is seen that a method and means of installing siding is disclosed herein which is extremely simple and efficient and accurate. This invention, therefore, accomplishes at least all of its stated objectives.

We claim:

1. A gage for installing siding, comprising, a fame means adapted to support a first length of siding in a relatively vertical position against a supporting wall, said frame means having a hook portion thereon adapted to hook on the upper edge of an installed length of siding, said frame means being adapted to support said first length of siding in partial overlapping condition with said installed length of siding, and release means on said frame means to release said first length of siding to permit said frame means and said hook portion to be first raised to release said hook portion from said installed length of siding, and then to permit said hook portion to be moved downwardly with said frame means wherey said hook portion moves downwardly between said partial overlapped portions of said first and said installed siding members, said frame means including a retainer flange to keep said first siding member from falling out of said gage in a direction outwardly from said wall, said retainer flange being an upstanding arm means and said hook portion being a vertical arm pivotally secured to said frame means, the upper end of said vertical arm terminating in a hook element, and the other end of said arm terminating in a cam surface, and a spring loaded plunger means is secured to said frame means and releasably engaging said cam surface.

2. A gage for installing siding,, comprising, a frame means adapted to support a first length of siding in a relatively vertical position against a supporting wall, said frame means having a hook portion thereon adapted to hook on the upper edge of an installed length of siding, said frame means being adapted to support said first length of siding in partial overlapping condition with said installed length of siding, and release means on said frame means to release said first length of siding to permit said frame means and said hook portion to be first raised to release said hook portion from said installed length of siding, and then to permit said hook portion to be moved downwardly with said frame means whereby said hook portion moves downwardly between said partial overlapped portions of said first and said installed siding members, said hook portion being a vertical arm pivotally secured to said frame means, the upper end of said vertical arm terminating in a hook element, and the other end of said arm terminating in a cam surface, and a spring loaded plunger means is secured to said frame means and releasably engaging said cam surface.

3. A gage for installing siding, comprising, a frame means adapted to support a first length of siding in a relatively vertical position against a supporting wall, said frame means having a hook portion thereon adapted to hook on the upper edge of an installed length of siding, said frame means being adapted to support said first length of siding in partial overlapping condition with said installed length of siding, and release means on said frame means to release said first length of siding to permit said frame means and said hook portion to be first raised to release said hook portion from said installed length of siding, and then to permit said hook portion to be moved downwardly with said frame means whereby said hook portion moves downwardly between said partial overlapped portions of said first and said installed siding members, said release means comprising a spring loaded horizontal plunger mounted on said frame means with one end therof adapted to support the bottom edge of said first length of siding, and means on said plunger for moving said plunger horizontally out of engagement with said first length of siding.

* * * * *